United States Patent [19]

Turek et al.

[11] 4,315,799

[45] Feb. 16, 1982

[54] ADJUSTABLE DECKLE

[75] Inventors: Mitchell C. Turek, Suffield, Conn.; H. Gary Garab, Glens Falls, N.Y.

[73] Assignee: Albany International Corp., Menands, N.Y.

[21] Appl. No.: 122,234

[22] Filed: Feb. 15, 1980

[51] Int. Cl.[3] ..... D21F 1/48

[52] U.S. Cl. ..... 162/353; 162/352; 162/366

[58] Field of Search ..... 162/351, 353, 366, 352

[56] References Cited

U.S. PATENT DOCUMENTS

| | | | |
|---|---|---|---|
| 3,836,428 | 9/1974 | McConaughy | 162/366 |
| 3,928,125 | 12/1975 | Poeschl | 162/352 |
| 4,055,459 | 10/1977 | Best | 162/352 |

*Primary Examiner*—Peter Chin

*Attorney, Agent, or Firm*—Kane, Dalsimer, Kane, Sullivan & Kurucz

[57] ABSTRACT

An adjustable deckle is provided for use in papermaking machinery to be positioned between the ends of adjacent wear surfaces to facilitate prevention of loss of vacuum applied to the wear surfaces in operation of the machinery. The deckle includes an elongated member having a pair of opposing elongated front and rear faces, a pair of elongated top and bottom faces and a pair of end faces. The front face has a configuration conforming with the configuration of an adjacent edge of one wear surface when the deckle is inserted between two wear surfaces. The rear face has a recess therein and a resilient strip is mounted in the recess. A shiftable element is also mounted in the recess by engagement between surfaces of the element and surfaces of the elongated member. The shiftable element has a portion exposed through an opening in the rear face of the elongated member. The exposed portion of the element is designed to mate with an adjacent edge of the other wear surface and the resilient means permits shifting of the element within the recess to accommodate for dimensional differences between the two wear surfaces when the deckle is inserted between the ends thereof.

12 Claims, 6 Drawing Figures

ADJUSTABLE DECKLE

BACKGROUND OF THE INVENTION

Conventional types of machinery, such as various dewatering mechanisms utilized in the papermaking industry, employ vacuum dewatering systems for removing water from a substrate such as a papermaker's felt. Wear surfaces on the machinery for contact with the moving substrate take a variety of different forms. For example, on the wet end of papermaking machinery a variety of different shape foil or blade structures are employed including foils in combination with vacuum systems to dewater the substrate. Suction pipes and suction boxes, particularly wet boxes, are often used. The different types of replaceable or adjustable wear surfaces are designed to accommodate parameters involved in the system. Different factors are taken into consideration such as the nature and condition of the substrate being handled and dewatered, the type of suction system employed, and the type of wear surface or foil employed for facilitating the dewatering process.

In general, the wear surfaces are arranged in parallel position on a supporting surface interconnected with a source of vacuum. The wear surfaces, for example vacuum foils, are spaced so that elongated slots therebetween form openings for application of the vacuum. Thus, the combination of engagement with the foils and the vacuum force results in water being drawn through the slots and collected and the substrate or felt being dewatered in the desired manner.

One difficulty that occurs in utilizing the parallel arrangement of foils or wear surfaces is that the in between spaces extending the length of the elongated elements produce a loss of vacuum at the ends. This is due to several circumstances. First, the felt or substrate is not as wide as the width of the elongated foils and thus any openings at the end portions would be open to atmosphere and accordingly produce a reduction in vacuum. Second, sealing the ends is difficult in view of the fact that the slots between the wear surfaces are open ended causing introduction of air and again resulting in loss of vacuum. Accordingly, end deckles are frequently used to seal the ends of the slots between the foils and maintain a maximum vacuum condition in the central portion of the slots where the substrate travels for dewatering purposes.

The difficulty with utilizing deckles for end seals resides in the fact that the spacing between wear surfaces or foils is not a constant parameter. Dimensional variations occur in manufacture and assembly. Accordingly, mass produced deckles of generally constant dimensions are difficult to fit in slots of varied sizes. Clearly, an adjustable deckle is desirable because of the difficulty in maintaining exact blade or foil spacing in commercially mass produced products. An adjustable deckle would facilitate original manufacture of the machinery as well as field replacement.

Various types of variable width end deckles have been utilized to some degree. Adhesively bonded cushions have been used with the cushion being designed to permit compression and accordingly variation in the width of a deckle structure. Adhesives cause additional manufacturing steps and materials particularly in the application of a suitable adhesive and also present difficulties in use particularly where the adhesive fails and premature deterioration of the deckle occurs. In place of adhesively bonded compressive elements, compressive elements have been affixed to the deckle structure by means of screws or other similar fastener to avoid the difficulties present with adhesive. However, use of screws or other types of fasteners again adds to the manufacturing components and steps of assembly thus adding to the overall cost of the structure.

Accordingly, there is clearly a need for further improvement in deckle design to provide the needed adjustment for spacing purposes to accommodate for dimensional variations of wear surfaces such as blades or foils.

SUMMARY OF THE INVENTION

With the above background in mind, it is among the primary objectives of the present invention to provide an adjustable deckle for the ends of a wear surface or foil which has the necessary adjustability in the form of compressability for purposes of accommodating tolerance differences and dimensional variations in spaced wear surface arrangements such as vacuum foils used for dewatering papermaker's felt and the like.

The end deckle of the present invention is designed with two separable components mechanically interlocked and shiftable with respect to one another by means of a mechanically captured compressable strip. The system requires no adhesive or fastener such as screws or welds and the like.

It is an objective to provide an end deckle designed with sufficient resilient to accommodate for tolerance variations in spacing between fixed wear surfaces such as vacuum foils and wet boxes. The end deckle is designed with one face to mate with a mating edge on one of two adjacent foils and has a shiftable portion with a configuration for mating and interengagement with a mating edge on the other of the foils. In this manner, the deckle is designed to form a seal at the ends of the adjacent foils and prevents vacuum loss maintaining a desired maximum vacuum in the central slot area for application to a substrate being passed thereover.

There is sufficient adjustability in the shiftable portion of the end deckle so that it can accommodate a substantially wide spacing range to provide an end seal thus facilitating assembly and manufacture of a system and maintaining the cost factor at a minimum.

The adjustable end deckle of the present invention is inexpensively designed and includes two mechanically interlocked members one of which is slidably interengaged with the other for assembly while retaining limited relative movement therebetween and can be slidably removed for disassembly. A compressable strip is captured between the interengaged mechanical members thus eliminating the need for further components to assemble the parts of the end deckle.

Furthermore, in the design of the present invention, a retainer bar can also be provided to facilitate tight locking interengagement between the non-shiftable face of the end deckle and the adjacent edge of an adjoining foil. This design prevents shifting at the one side of the end deckle and maintains the adjustable shifting feature at the other side where the shiftable portion is in mating interengagement with another adjoining wear surface or foil. In this manner, the most effective tight sealing interengagement is maintained at the ends of adjoining foils by use of the adjustable end deckle.

The end deckle of the present invention is adaptable for use with a variety of different types of wear surfaces or foils. To accommodate different types of mating surfaces, the shiftable member engaging an edge of an adjoining wear surface can be provided with an appropriate structure for mating interengagement with appropriate mating structure on the wear surface. For example, among the types of interengaging mating surfaces that can be incorporated in the designs of the present invention are tongue and groove arrangements and pin and slot arrangements. Once again, the necessity of separate fasteners is eliminated thus providing the simplest and most economic structure for manufacture, and assembly and disassembly in use on conventional machinery such as that conventionally used in the papermaking industry.

The end deckle of the present invention is designed to be constructed of a commonly used material, such as UHMW Polyethylene (ULTRA IV) or glass fiber pultrusion, for the rigid portions and rubber or other cellular material for the compressive strip captured between the rigid portions.

The adjustable deckle of the present invention facilitates original manufacture as well as field replacement and is helpful in overcoming the difficulty in maintaining exact blade spacing in conventionally available products in the papermaking industry and the like.

In summary, an adjustable deckle is provided for use on machinery to be positioned between the ends of adjacent wear surfaces to facilitate prevention of loss of vacuum applied to wear surfaces in operation of the machinery. The deckle includes an elongated member having a pair of opposing elongated front and rear faces, a pair of elongated top and bottom faces and a pair of end faces. The front face has a configuration conforming with the configuration of an adjacent edge of one wear surface when the deckle is inserted between two wear surfaces. The rear face has a recess therein with resilient means positioned in the recess. A shiftable element is mounted in the recess by engagement between surfaces of the element and surfaces of the member and has a portion exposed through the opening in the rear face of the elongated member. Finally, means is on the exposed portion of the element to mate with an adjacent edge of the other wear surface and the resilient means permitting shifting of the element within the recess to accommodate for dimensional differences between the two wear surfaces when the deckle is inserted between the ends thereof.

With the above objectives in mind, reference is made to the attached drawings.

DETAILED DESCRIPTION

Figure 1:
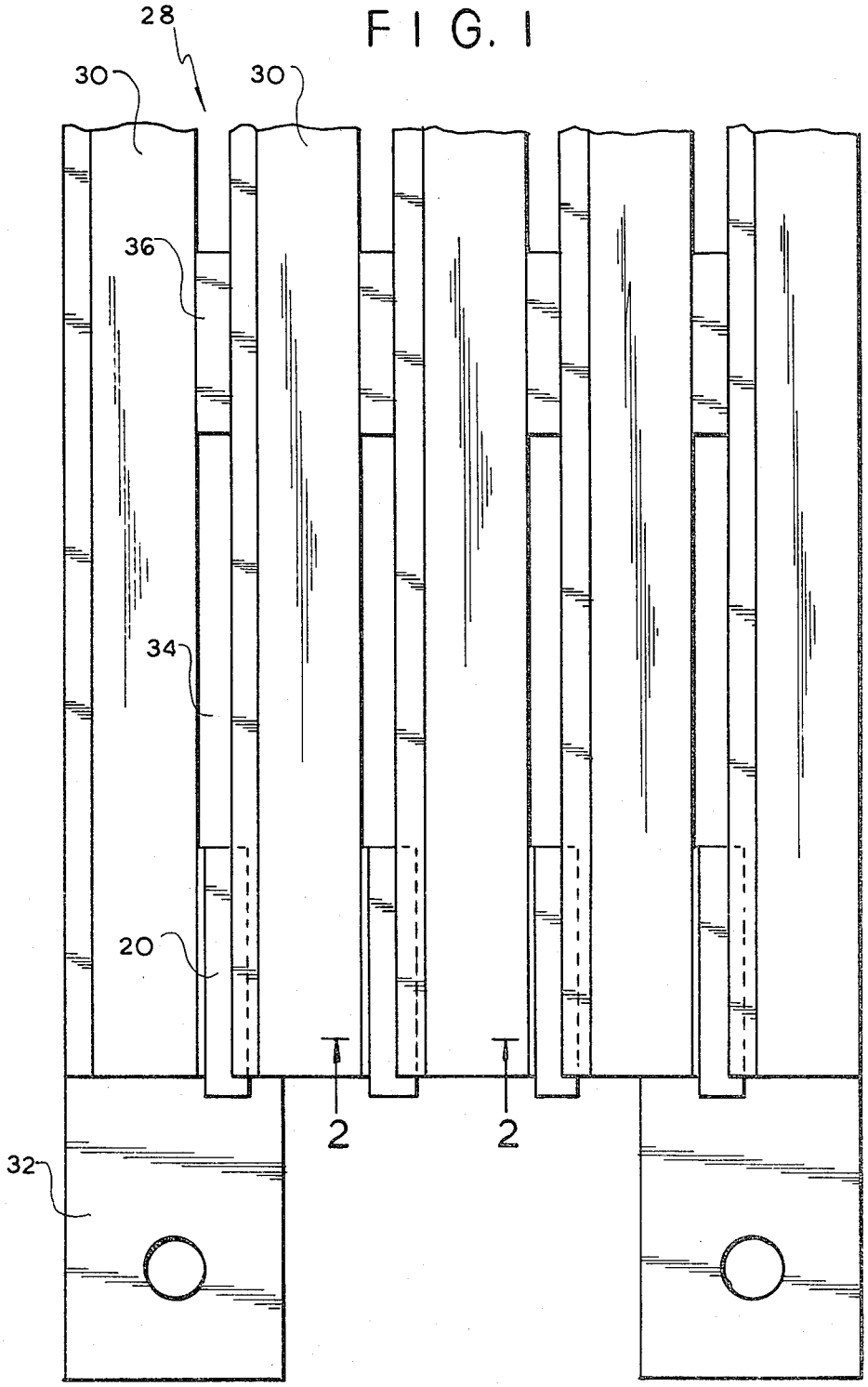
FIG. 1 is a top plan view of a plurality of adjustable deckles of the invention shown mounted on a fragmentary portion of papermaking machinery.
Figure 4:
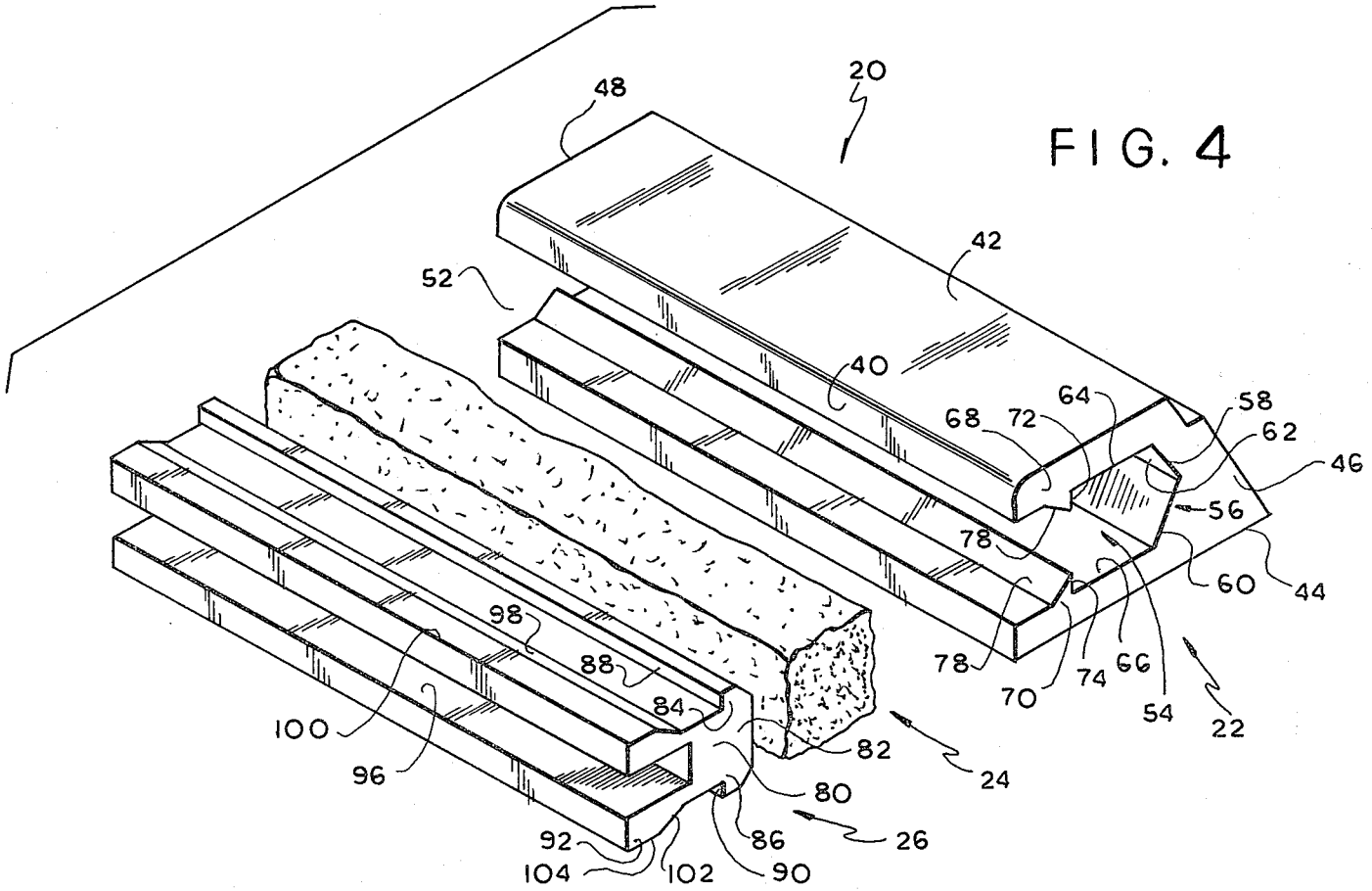
FIG. 4 is an exploded perspective view of the end deckle of the invention.

End deckle 20 as shown in FIG. 4 includes three components. Mechanically interlocked with one another is an elongated member 22, a compressable strip 24 and a shiftable element 26. The elongated member 22 and the shiftable element 26 can be formed of conventional material such as a glass fiber pultrusion of UHMW Polyethylene. The compressable member 24 can be formed of natural or synthetic rubber or other resilient or compressive cellular material. The end deckle 20 is designed for use on conventional machinery such as vacuum foils and suction boxes or pipes commonly used in the papermaking industry, particularly on the wet end of the machinery. An example of this type of machinery 28 is depicted in FIG. 1. The machinery includes a plurality of spaced blades or foils 30 which are elongated members arranged in substantially parallel relationship to one another. The foils 30 are mounted on a support structure 32 which in turn is connected to a source of suction so that vacuum is applied to the slots 34 between each pair of foils 30 from appropriate openings 36 connected to the source of suction (not shown) within the machine. As shown in FIG. 1, an end deckle 20 is mounted at each end of the machinery 28 between each pair of adjacent foils 30 so that both ends of the foils are sealed. This prevents the machinery from losing vacuum between foils 30 by communication with atmosphere at its ends. Thus, a substrate such as a papermaker's felt to be dewatered can be passed over the central portion of slot 34 between each pair of foils in a direction perpendicular to the longitudinal axis of the foils 30 and be subjected to maximum vacuum for drawing water from the substrate down through openings 36 for removal and collection. In this manner, in the papermaking industry, for example, felts or similar substrates can be dewatered. This commonly occurs at the wet end of the papermaking machine process.

As previously stated, the space 34 between each pair of foils 30 varies due to construction and assembly tolerances and other dimensional variations which occur in the normal construction of the machinery. Thus, each end deckle 20 is adjustable so that it fits a range of spaces that may occur between any pair of adjacent foils 30. This facilitates manufacture and operation of the machinery and maintains the overall system at the lowest possible cost.

Returning to consideration of the details of construction of end deckle 20, attention is directed to FIG. 4. Elongated member 22 includes a front face 38, a rear face 40, a top face 42, a bottom face 44, and a pair of opposing end faces 46 and 48.

In the embodiment of FIGS. 1–4 front face 38 is beveled at an appropriate angle with respect to the vertical and includes a step 50 adjacent its upper end. Top face 42 and bottom face 44 are substantially flat and parallel to one another. Rear face 40 has a central opening 52 along its length which provides access to a recess 54 extending inwardly from the rear face toward the front face 38.

Recess 54 is irregular in configuration with a forward base 56 formed of two portions 58 and 60 terminating in a central apex 62. The end of portion 58 distal from apex 62 meets a horizontal top leg wall 64 which is opposed by a horizontal bottom leg wall 66 extending from the end of base portion 60. Adjacent to opening 52 and extending downward from top leg wall 64 is a longitudinal flange 68. A mating opposing flange 70 extends upward from bottom leg wall 66 of recess 54. Each flange 68 and 70 is formed with an inner vertical wall 72 and 74 respectively and a sloped outer wall 76 and 78 respectively.

Compressable strip 24 is elongated and is rectangular or square in configuration and is dimensioned so that it can fit through opening 52 or through open end faces 46 and 48 into recess 54 until it is positioned adjacent to and in contact with portions of base 56 and top and bottom leg walls 64 and 66. In this manner, the compressable strip 24 is captured on three of its four elongated faces by surfaces within recess 54 of elongated member 22. The remaining elongated face of strip 24 is retained by shiftable element 26 when coupled with elongated member 22 thus completing the assembly and preventing strip 24 from being removed from deckle 20. No other fastening element or means is required. Frictional engagement with the engaging surfaces helps to maintain compressable strip 24 in position within recess 54. In combination with the compressive force applied by shiftable element 26 this results in the retention of the compressable strip 24 in such a manner that it will not depart from within recess 54 through the open end faces 46 and 48.

Shiftable element 26 includes a central rectangularly shaped portion 80. An enlarged head 82 extends from the forward side of central portion 80 so that top projection 84 and bottom projection 86 extend outwardly from central portion 80 and form a top shoulder 88 and a bottom shoulder 90 respectively.

An enlarged interlocking portion 92 extends rearwardly from central portion 80 and terminates in a vertical rear face 94. The central portion of the rear face is formed with a slot 96. Enlarged interengaging portion 90 becomes larger as it extends rearwardly from central portion 80 due to a tapered outer upper surface 98 extending to a flat surface 100 of largest diameter. A similar tapered surface 102 tapers outwardly to a flat outer surface 104. The outer surfaces 100 and 104 are spaced wider than the outer diameter of central portion 80 thus making portion 92 an enlarged portion with respect to the central portion 80.

In assembly, compressable strip 22 is compressed and inserted into recess 54 either through opening 52 or either of the open faces 46 and 48. The dimensions of shiftable element 26 are such that it can be slidably inserted in elongated member 22 through either of the open faces 46 or 48 and it will be mechanically interlocked in position therein. The shiftable limit 26 does have restricted forward and rearward movement. The rearward movement is restricted by interengagement between shoulder 88 and 90 on the element 26 and respective surfaces 72 and 74 on elongated member 22. Movement in the forward direction is restricted by interengagement between tapered surfaces 98 and 102 on element 26 and mating tapered surfaces 76 and 78 respectively on the elongated member 22. Additionally, movement in the forward direction is more difficult than movement in the rearward direction since it requires compression of compressable member 24.

Figure 2:
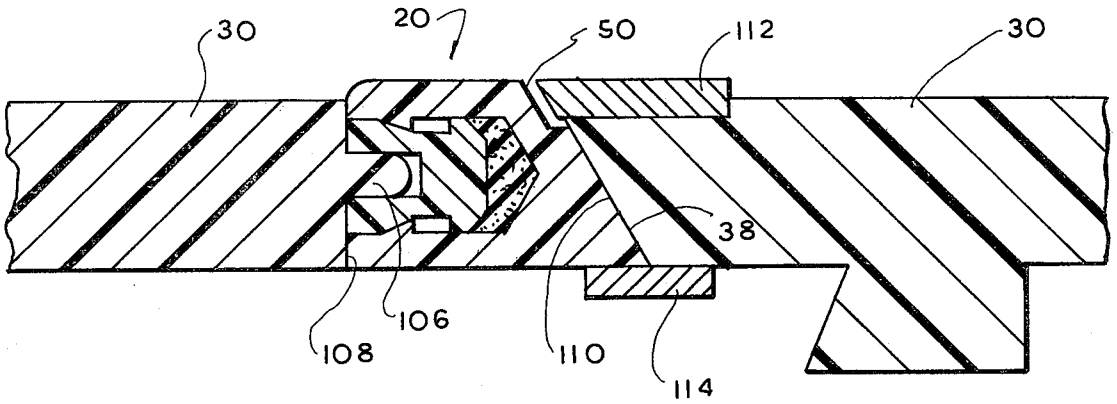
FIG. 2 is an enlarged sectional elevation view thereof taken along the plane of line 2—2 of FIG. 1.
Figure 3:
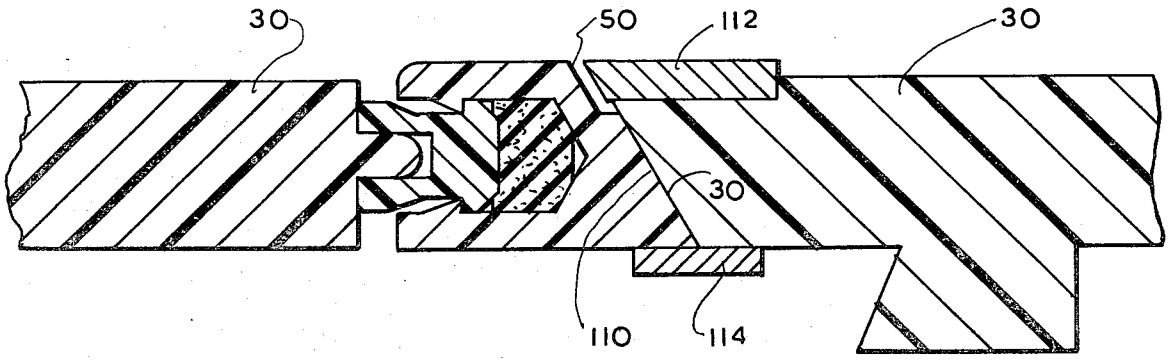
FIG. 3 is an enlarged fragmentary portion thereof showing the end deckle mounted in a wider spacing between adjacent foils and the corresponding adjusted position of the end deckle.

Adjustable deckle 20 is thus fully assembled and ready for insertion between two foils 30. The shiftability of element 26 provides for a combination of different spacing between a pair of adjacent foils 30. The two extreme positions are shown in FIGS. 2 and 3 respectively. In FIG. 2, deckle 20 is at its smallest width. Element 26 has been depressed inwardly compressing compressable strip 24 until the rear face 94 of the strip is flush with the rear face 40 of the elongated member 22. Tapered surfaces 98 and 102 on element 26 are in mating interengagement with corresponding tapered surfaces 76 and 78 on elongated member 22 thus preventing further inward movement of element 26 into the recess 54. An elongated pin 106 extends forward from the adjacent edge 108 of the adjoining foil 30. Pin 106 is positioned in slot 96 thus completing the interengagement between deckle 20 and foil 30. Pin 106 is inserted into the slot 96 until edge 108 engages with the rear faces 94 and 40 on the element 26 and elongated member 22.

On the forward side of deckle 20, tapered front face 38 engages with a mating tapered adjoining edge 110 on foil 30. With the type of foil depicted in FIGS. 2 and 3, a blade surface 112 is provided on the upper tip of foil 30 and the recess 50 in tapered front face 38 of the deckle accommodates this blade 112. To ensure tighter interengagement between front face 38 and adjoining edge 110 and to provide a support for deckle 20 a retainer bar 114 abuts the adjoining deckle 20 and foil 30 and is conventionally mounted on machine 32.

FIG. 3 shows a similar arrangement of elements with the exception that the space between foils 30 is wider than that shown in FIG. 2. However, the adjustability of deckle 20 permits its use in that location as well as any intermediate position. Shiftable element 26 has been moved rearwardly until surfaces 88 and 90 on head 82 engages with surfaces 72 and 74 within recess 54 and these surfaces are urged into interengagement due to the expanding nature of compressable strip 24. A pin 106 is still mounted in slot 94 to retain the sealed interengagement on the rear side of the deckle and the front side of the deckle is still sealed in the same manner as shown in FIG. 2 with face 38 in mating engagement with adjoining edge 110 and an appropriate retainer bar 114 holding the elements in tight interengagement. Once again, a blade potion 112 is accommodated by the recess 50 in face 38. The type of foil or blade arrangement shown in FIGS. 1–4 is a common structure which can be formed of a fiber glass pultrusion with an appropriate blade edge portion mounted in conventional fashion in the position shown. The foil is of the type which includes a pin extending from the edge opposite the blade edge.

Figure 5:
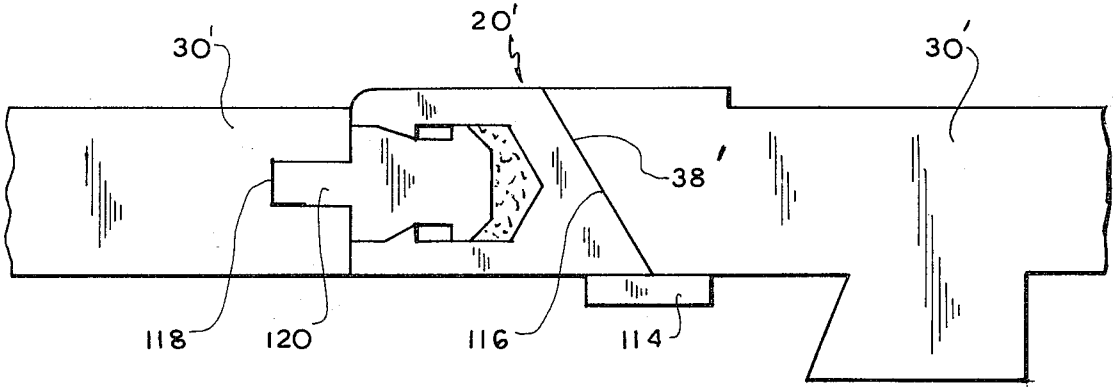
FIG. 5 is a sectional end view of an alternative embodiment of the end deckle of the invention mounted between a fragmentary portion of two adjacent foils.
Figure 6:
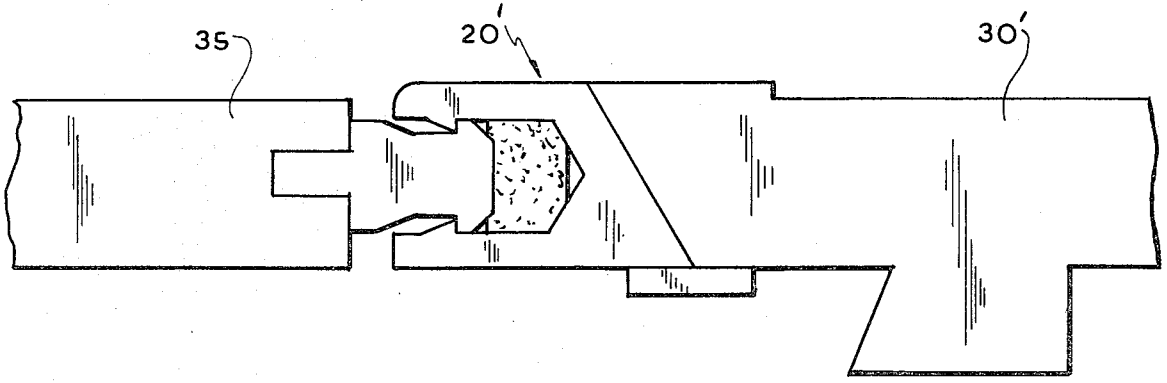
FIG. 6 is a sectional side elevation view of the alternative form of end deckle shown in adjusted position mounted between fragmentary portions of two other foils spaced a greater distance apart.

An alternative common type of foil is depicted in FIGS. 5 and 6 and deckle 20 has been modified to be used in a similar manner as an adjustable end deckle for that type of foil. The foil 30' of FIGS. 5 and 6 is a one piece structure well known in the art which can be formed of a material such as UHMW polyethylene, for example a material commercially known as ULTRA IV or any common substitute therefor. The one piece blade 30' has a continuously tapered leading edge 116 from top to bottom. The trailing edge is formed with an elongated groove 118 instead of the extending pin of the previous embodiment. In all other respects the foils 30' correspond to foils 30 and are mounted on machinery 32 in the same manner. Adjustable deckle 20' has been modified to accommodate the differences in the leading and trailing edges of the foil. In all other respects, deckle 20' is identical to adjustable deckle 20 discussed above and operates in the same manner.

In place of slot 96 in the rear face 94 of the adjustable element, a protruding tongue 120 is provided to mate with groove 118 in the adjacent edge of adjoining foil 30'. Similarly, the front face 38' of elongated member 22' is tapered continuously from top to bottom to mate with the tapered leading edge 116 of the adjoining foil 30'. A suitable retainer bar 114 is employed to reinforce the engagement between face 38' and leading edge 116 and to support the deckle 20'. FIG. 5 shows end deckle 20' adjusted for a smaller opening between foils 30' in a similar manner as shown in FIG. 2 for deckle 20. In the same way, FIG. 6 shows end deckle 20' adjusted for a wider opening between adjacent foils 30'. This position corresponds to that shown in FIG. 3 with respect to the previously discussed embodiment. In all other respects, end deckle 20' is identically constructed and assembled as end deckle 20 and can be used on papermaking or similar machinery 32 in the same manner as end deckle 20.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. An adjustable deckle positioned between the ends of adjacent wear surfaces of a vacuum of a papermaking machine, said deckle facilitate prevention of loss of vacuum applied to the wear surfaces in operation of the machinery, said deckle comprising; an elongated member insertable between two adjacent wear surfaces and having a pair of opposing elongated front and rear faces, a pair of elongated top and bottom faces and a pair of end faces, the front face having a configuration conforming with the configuration of an adjacent edge of one wear surface, the rear face having a recess therein, a shiftable element mounted in the recess by engagement between surfaces of the element and surfaces of the member and having a portion exposed through an opening in the rear face of the elongated member, and means on the exposed portion of the element to mate with an adjacent edge of the other wear surface, and resilient means in said recess permitting shifting of the element within the recess to accommodate for dimensional differences between the two wear surfaces.

2. The invention in accordance with claim 1 wherein the wear surfaces are papermaker's foils, a plurality of the foils arranged in side by side adjacent substantially parallel position, a vacuum source applied to the foils to apply vacuum to the spaces therebetween, a deckle positioned between each pair of adjacent foils at each end of the elongated foils each deckle being significantly shorter than the length of the foils so that the vacuum is applied to the remaining opening between the foils not closed by the deckles.

3. The invention in accordance with claim 1 wherein at least one of the end faces is open to the recess permitting the element to be slidably reciprocated into and out of the recess from at least one end thereof.

4. The invention in accordance with claim 3 wherein the resilient means is a compressable cushion in the recess in position to be compressed and permitted to expand so as to accommodate the shifting of the element inwardly or outwardly with respect to the rear face of the elongated member enabling the deckle to adjust for dimensional variations in the space between two adjacent wear surfaces.

5. The invention in accordance with claim 4 wherein the compressable strip is formed of rubber material.

6. The invention in accordance with claim 4 wherein the element has at least one flange thereon and the recess having at least one mating flange extending inwardly thereof for engagement with the flange on the element in order to mechanically interlock the element within the elongated member in a manner which will prevent its removal through the rear face of the elongated member.

7. The invention in accordance with claim 6 wherein the recess in the rear face of the elongated member is open to the rear face and includes a base wall and a pair of spaced top and bottom leg walls substantially parallel to one another extending between the base wall and the opening to the recess in the rear face of the elongated member, the compressable strip mounted adjacent the base wall and dimensioned so as to extend partially rearwardly from the base wall and is captured by the leg walls, a flange on the top leg wall and a corresponding flange on the bottom wall in alignment with the flange in the top wall, both flanges extending toward one another and spaced from the base wall and from the compressive strip, the shiftable element including an enlarged head on one end to be captured between the flanges on the top and bottom walls and the compressive strip and interlocking engagement means on the other end exposed to the opening of the recess in the rear face of the elongated member for interengagement with the adjacent edge of an adjoining wear surface whereupon dimensional variations for permitting interlocking with the adjacent edge of the adjoining wear surface is accommodated by shiftability of the element toward and away from the base wall and corresponding compression and expansion of the compressable strip in response thereto.

8. The invention in accordance with claim 7 wherein the means on the exposed portion of the element to mate with the adjacent edge of an adjoining wear surface is a slot in the shiftable element in position to mate with a pin projecting from the adjacent edge of the adjoining wear surface.

9. The invention in accordance with claim 7 wherein the means on the exposed portion of the shiftable element to mate with an adjacent edge of an adjoining wear surface is a tongue formed on the portion of the shiftable element exposed to the adjoining wear surface and extending rearwardly in position to be inserted into a groove formed in the adjacent edge of the adjoining wear surface to mate and interengage therewith.

10. The invention in accordance with claim 1 wherein the front face of the elongated member is beveled at an angle to permit its mating with a beveled surface on the adjacent edge of an adjoining wear strip.

11. The invention in accordance with claim 1 wherein a retainer bar abuts the deckle and an adjoining wear surface in adjacent with the mating front face of the elongated member and the adjacent edge of the adjoining wear surface to assist in maintaining interengagement therebetween and to support the deckle.

12. The invention in accordance with claim 6 wherein the element has a projecting portion spaced from the at least one flange so as to capture the flange in the recess therebetween and engageable therewith to limit the amount of shifting of the element both inward and outward with respect to the rear face of the elongated member.

* * * * *